US010099812B2

(12) United States Patent
Shaw

(10) Patent No.: US 10,099,812 B2
(45) Date of Patent: Oct. 16, 2018

(54) RIGID CORRUGATED EVIDENCE RETAINING ENCLOSURE WITH TAMPER EVIDENT AND COMBINED ACCESS AND RECLOSURE/RECORDAL INDICIA CAPABILITIES

(76) Inventor: Raymond R. Shaw, Farmington Hills, MI (US)

( * ) Notice: Subject to any disclaimer, the term of this patent is extended or adjusted under 35 U.S.C. 154(b) by 1730 days.

(21) Appl. No.: 13/104,627

(22) Filed: May 10, 2011

(65) Prior Publication Data

US 2011/0210031 A1 Sep. 1, 2011

Related U.S. Application Data

(63) Continuation-in-part of application No. 12/023,792, filed on Jan. 31, 2008, now Pat. No. 8,142,075, which
(Continued)

(51) Int. Cl.
*B65D 5/43* (2006.01)
*B65D 5/46* (2006.01)
(Continued)

(52) U.S. Cl.
CPC ..... *B65D 5/46096* (2013.01); *B65D 5/4204* (2013.01); *B65D 5/4233* (2013.01); *G09F 3/0341* (2013.01); *B65D 2101/00* (2013.01)

(58) Field of Classification Search
CPC ..... B65D 53/08; B65D 2101/00; B65D 2101/0007; B65D 2101/0015; B65D 2101/0092
(Continued)

(56) References Cited

U.S. PATENT DOCUMENTS 376,005 A 1/1888 Manahan
526,799 A 10/1894 Barnard
(Continued)

FOREIGN PATENT DOCUMENTS

JP 3100478 A 4/1991
KR 20-0296792 12/2002

OTHER PUBLICATIONS

U.S. Appl. No. 10/891,347, filed Jul. 14, 2004.
(Continued)

*Primary Examiner* — Nathan J Newhouse
*Assistant Examiner* — Nina Attel
(74) *Attorney, Agent, or Firm* — Dinsmore & Shohl LLP

(57) ABSTRACT

A rigid and tamper evident evidence container exhibiting interconnected sides, a bottom and upwardly extending and inter-foldable flaps for sealing and holding items of evidence in a secure and documentation verifiable fashion. The rigid and corrugated material exhibits either waterproof/non-fluid absorbent or fluid absorbent properties and is particularly suited for use by law enforcement personnel in the collection of evidence for criminal prosecution. Access and tamper-evident resealing structure is located along at least one facing side of the rigid material to allow for documentable re-entry of a pre-sealed container. The tamper-evident resealing structure includes a corrugated punch out section for establishing access to previously tagged evidence, combined with an over sized rigid or flexible patch with a tacky application surface for establishing secure re-closure of the opening. An outside face of the patch exhibits indicia recordable information fields for documenting the particulars of the re-entry and subsequent tamper evident-resealing event.

17 Claims, 6 Drawing Sheets

Related U.S. Application Data is a continuation-in-part of application No. 10/891,347, filed on Jul. 14, 2004, now abandoned.

(51) Int. Cl.
*B65D 5/42* (2006.01)
*G09F 3/03* (2006.01)

(58) Field of Classification Search
USPC ..... 229/102, 117.09, 117.12–117.16, 118, 229/121, 122, 123.1–123.3, 125.01, 229/125.015, 125.15, 126–128, 132, 136, 229/141–143, 147, 5.81–5.85, 240, 242, 229/124; 383/203, 204, 78, 5, 66, 83, 89
See application file for complete search history.

(56) References Cited

U.S. PATENT DOCUMENTS 1,955,310 A 4/1934 Powell et al.
1,984,611 A * 12/1934 Weaver ..... 229/117.14
1,987,751 A 1/1935 Sahm
2,175,387 A 10/1939 Goding
2,192,131 A 2/1940 Fishwick
2,385,576 A 9/1945 Israel
2,437,072 A 3/1948 Campbell
2,810,510 A 10/1957 Korn
2,998,180 A * 8/1961 Dehoney, Jr. ..... 229/136
3,087,669 A 4/1963 Russell
3,142,436 A 7/1964 Heigl
3,203,621 A 8/1965 Wright
3,255,871 A 6/1966 Butler
3,309,008 A 3/1967 Huck
3,451,535 A * 6/1969 Caplan ..... 229/102
3,460,742 A 8/1969 Langdon
3,706,410 A 12/1972 Baker
3,806,984 A 4/1974 Hilsabeck
3,865,304 A 2/1975 Mojonnier et al.
4,066,167 A * 1/1978 Hanna et al. ..... 383/204
4,175,604 A 11/1979 Bonner
4,384,670 A 5/1983 Dicker
4,479,588 A 10/1984 Davis et al.
4,518,115 A * 5/1985 Sedwick ..... 229/117.14
4,566,129 A 1/1986 McNamee
4,573,634 A 3/1986 Kohler et al.
4,580,683 A 4/1986 Gochenour
4,614,297 A 9/1986 Davis et al.
4,653,113 A 3/1987 Taylor et al.
4,655,388 A 4/1987 Fleming
4,750,609 A * 6/1988 Felis ..... 206/1.7
4,752,028 A 6/1988 Ogura
4,826,004 A * 5/1989 Dupuy ..... 229/162.7
4,874,096 A 10/1989 Tessera-Chiesa
4,948,266 A 8/1990 Bencic
4,961,503 A 10/1990 Bell
5,060,848 A 10/1991 Ewan
5,103,979 A 4/1992 Hustad
5,108,194 A * 4/1992 Raden ..... 383/5
5,135,313 A * 8/1992 Bowman ..... 383/5
5,148,970 A 9/1992 Johnston
5,186,900 A 2/1993 Jensen et al.
5,265,794 A 11/1993 Johnston
5,290,104 A 3/1994 Sengewald
5,364,189 A 11/1994 Kuge et al.
5,407,277 A 4/1995 Burke et al.
5,422,067 A 6/1995 Barney
5,503,328 A 4/1996 Roccaforte et al.
5,507,428 A 4/1996 Robinson, Jr. et al.
5,582,343 A * 12/1996 Dalvey ..... 229/101
5,606,846 A 3/1997 Raby et al.
5,743,392 A 4/1998 Chapman
5,758,971 A 6/1998 Goglio et al.
5,897,210 A * 4/1999 Giblin et al. ..... 383/98
5,935,847 A 8/1999 Smith et al.
5,957,583 A 9/1999 DeClements, Jr. et al.
6,047,883 A 4/2000 Calvert et al.
6,048,008 A 4/2000 Shaw
6,085,903 A 7/2000 Jotcham et al.
6,126,000 A 10/2000 Tung
6,164,821 A 12/2000 Randall
6,171,260 B1 * 1/2001 Hochmeister et al. ..... 600/572
6,296,388 B1 10/2001 Galomb et al.
6,338,572 B1 1/2002 Schneck
6,446,861 B1 9/2002 Smith
6,468,611 B1 10/2002 Haskin
6,471,123 B1 * 10/2002 Jensen ..... 229/125.37
6,860,421 B2 3/2005 Lo Duca
6,886,980 B1 5/2005 Diplock
7,267,261 B2 9/2007 Lo Duca
7,510,080 B2 3/2009 Smart et al.
7,614,542 B2 11/2009 Lo Duca
7,717,319 B2 5/2010 Adam
2001/0022318 A1 9/2001 Kaden et al.
2002/0164088 A1 11/2002 Collins
2003/0075593 A1 4/2003 Wood
2004/0007867 A1 1/2004 Vaughan
2004/0067326 A1 * 4/2004 Knoerzer et al. ..... 428/34.1
2005/0117819 A1 6/2005 Kingsford et al.
2005/0145683 A1 7/2005 Alagna et al.
2005/0284776 A1 * 12/2005 Kobayashi et al. ..... 206/210
2006/0013512 A1 1/2006 Shaw
2006/0144909 A1 * 7/2006 Kohlweyer ..... 229/104
2007/0140597 A1 * 6/2007 Donovan et al. ..... 383/14
2010/0252618 A1 10/2010 Adam et al.

OTHER PUBLICATIONS

U.S. Appl. No. 11/294,827, filed Dec. 6, 2005.
U.S. Appl. No. 12/023,792, filed Jan. 31, 2008.
U.S. Appl. No. 12/417,253, filed Apr. 2, 2009.

* cited by examiner

RIGID CORRUGATED EVIDENCE RETAINING ENCLOSURE WITH TAMPER EVIDENT AND COMBINED ACCESS AND RECLOSURE/RECORDAL INDICIA CAPABILITIES

CROSS-REFERENCE TO RELATED APPLICATIONS

This application is a continuation-in-part of application Ser. No. 12/023,792 filed Jan. 31, 2008, which is in turn a continuation-in-part of application Ser. No. 10/891,347 filed on Jul. 14, 2004.

FIELD OF THE INVENTION

The present invention discloses a rigid paperboard corrugated construction, such as exhibiting four interconnected sides, a bottom and any arrangement of upwardly extending and inter-foldable flaps for sealing and holding items of evidence in a secure and documentation verifiable fashion. Additional access and tamper-evident resealing structure is located along at least one facing side of the rigid material, and to allow for documentable re-entry of a pre-sealed container. The tamper-evident resealing structure includes a corrugated punch out section for establishing access to previously tagged evidence, combined with an over sized rigid or flexible patch with a tacky application surface for establishing secure re-closure of the opening. An outside face of the patch exhibits indicia recordable information fields for documenting the particulars of the re-entry and subsequent tamper evident-resealing event.

BACKGROUND OF THE INVENTION

The prior art is well documented with varying examples of storage and retention articles, such including bag-like structures, containers and the like. These articles are configured for a variety of different uses, among these being the storage and retention of solids and fluids for varying applications. One example of a prior art flexible, self-supporting storage bag with hinged and framed closure is disclosed in Randall, U.S. Pat. No. 6,164,821.

Other rigid constructed and tamper evident packaging designs include such as those depicted in US Patent Application Publication No. 2005/0145683 to Alagna. U.S. Pat. No. 7,267,261 to Lo Duca teaches another type of tamper evident indicating box with breakable access portions to prevent re-closure.

It is also known to open a pre-sealed evidence bag, of any random design, through the application of a sharp edged knife or razor blade. In such situations, the individual seeking access to the interiorly held items will subsequently apply a layer of a generally known type of evidence tape over the incision, and additionally may or may not record the particulars associated with the evidence re-entry event, such as by marker upon the surface of the bag.

SUMMARY OF THE INVENTION

As previously described, the present invention discloses a rigid corrugated construction, such as including a heavy paperboard material exhibiting four interconnected sides, a bottom and any arrangement of upwardly extending and inter-foldable flaps for sealing and holding items of evidence in a secure and documentation verifiable fashion. The rigid and corrugated material exhibits either waterproof/non-fluid absorbent or fluid absorbent properties, dependent upon the nature of the evidence items being stored (e.g. fluid absorbent and breathable for use with blood or semen impregnated evidence items in order to retard mold/decay as well as waterproof construction for use with heaver and non-organic entrained evidence items such as weapons, etc.).

In each instance, the rigid and tamper evident proof construction provides for secure holding and retention of specified items of evidence, typically of greater weight than which can be safely stored in flexible paper bag construction (e.g. Kraft paper and the like). Additional features include such as a tamper-proof viewing window incorporated into a side of the rigid paperboard construction to facilitate ease of identification and inspection of interiorly held contents without compromising its tamper evident features. The present invention is particularly suited for use by law enforcement personnel in the collection of evidence for criminal prosecution.

Additional access and tamper-evident resealing structure is located along at least one facing side of the rigid material, and to allow for documentable re-entry of a pre-sealed container. The tamper-evident resealing structure includes a corrugated punch out section for establishing access to previously tagged evidence, combined with an over sized rigid or flexible patch with a tacky application surface for establishing secure re-closure of the opening. An outside face of the patch exhibits indicia recordable information fields for documenting the particulars of the re-entry and subsequent tamper evident-resealing event.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
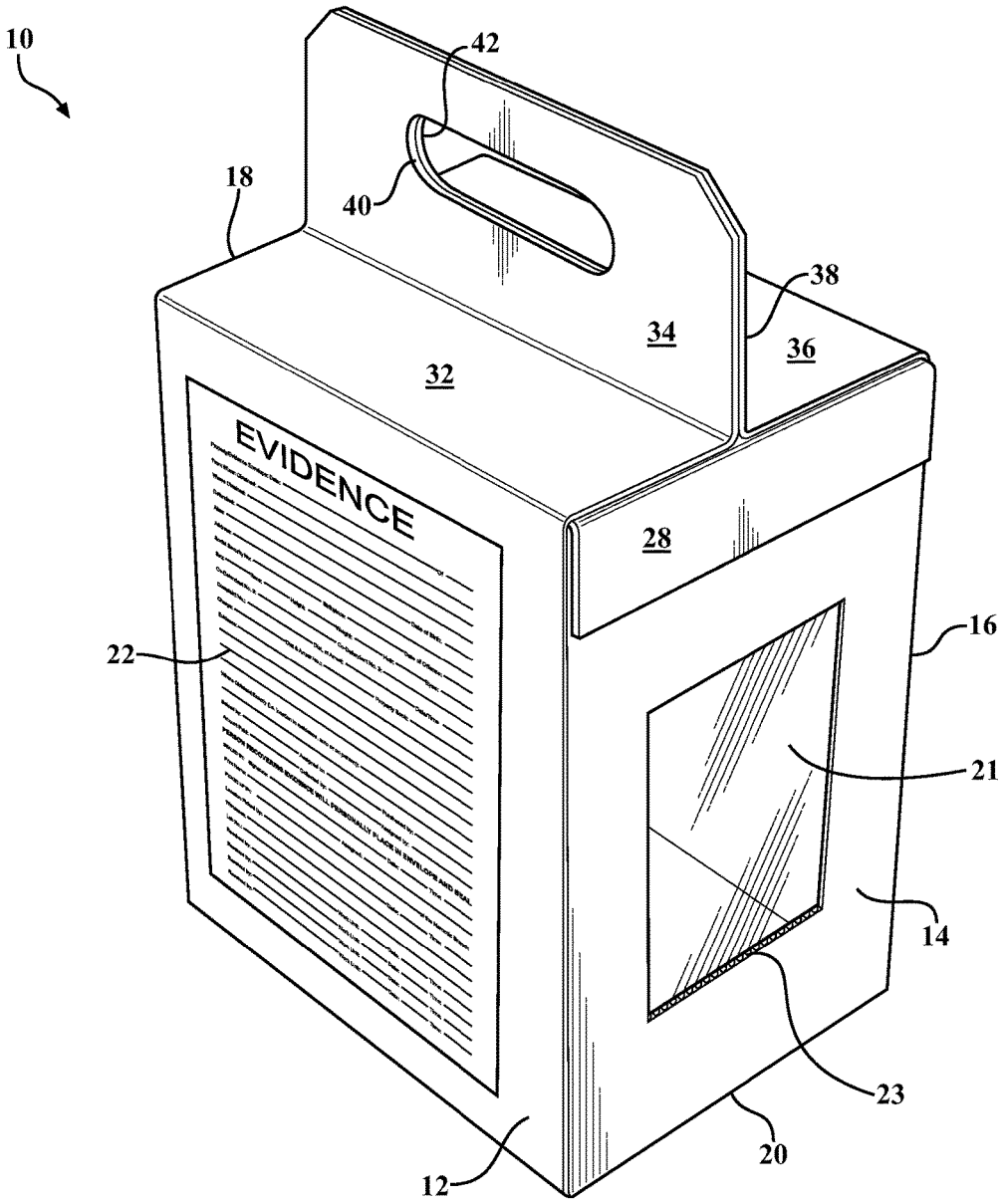
FIG. 1 is a perspective view of a rigid evidence retaining enclosure according to a first preferred embodiment of the present invention.
Figure 2:
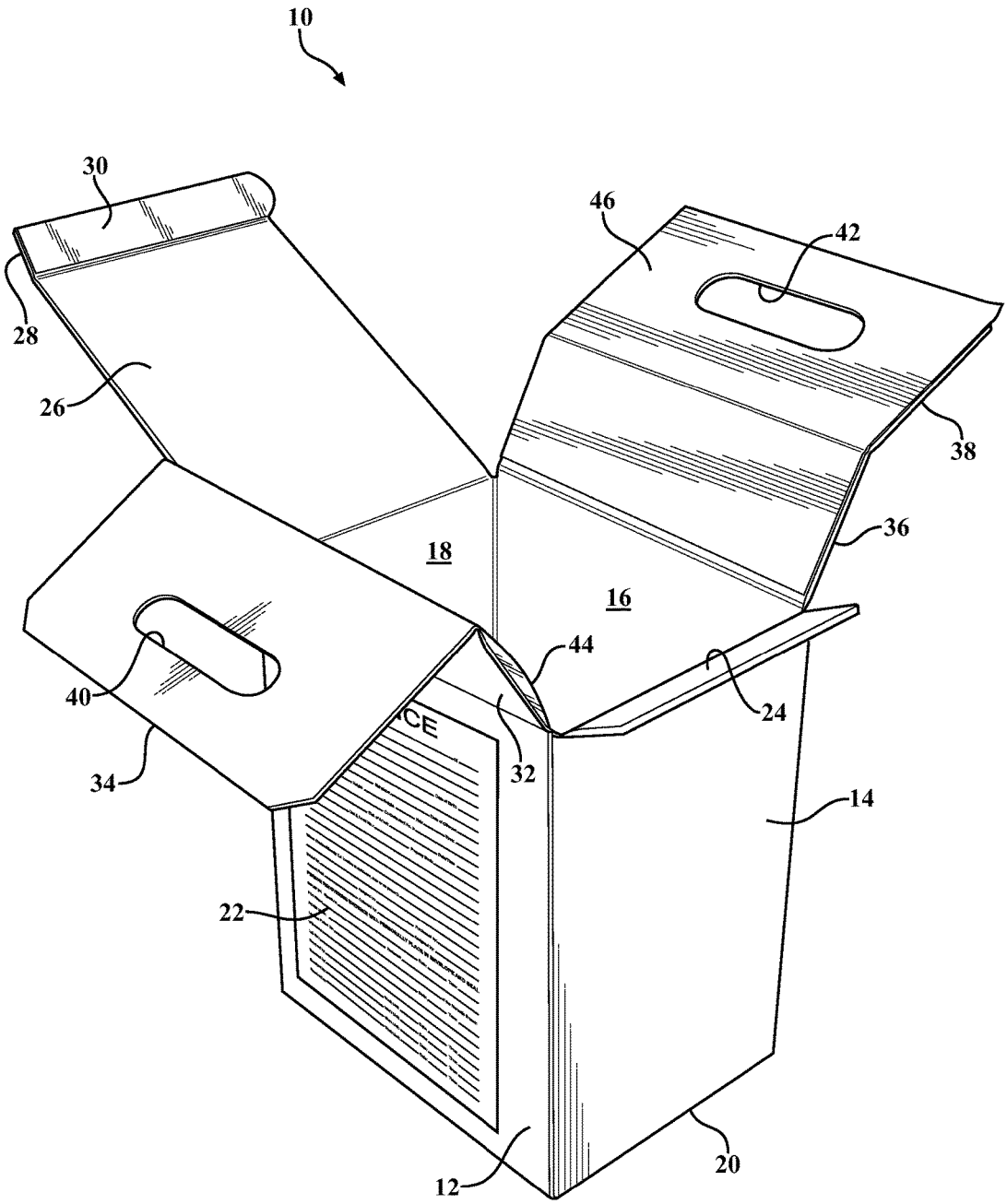
FIG. 2 is a succeeding view of the enclosure in FIG. 1 and further depicting the flap design including a first structurally supporting and inner fold over flap extending along a selected top edge which extends between parallel spaced apart and fold together flaps exhibiting opposing tacky surfaces.

Referring initially to FIGS. 1 and 2, a rigid supporting and tamper-evident construction is illustrated at 10 according to a first preferred embodiment of the present invention. As described previously, the present invention also discloses a structurally rigid and evidence retaining enclosure for the purpose of providing for secure holding and retention of evidence, such as in particular heavier item collected by law enforcement or crime scene investigation personnel and which may otherwise tear or degrade when placed within softer sided (e.g. Kraft paper evidence bag designs).

As previously described, the structurally supporting and rigid box-like construction of the evidence retaining enclosure is typically constructed of a corrugated paperboard material, such as which can exhibit similar properties of controlled breathability as is associated with flexible bag-like evidence retaining enclosures including such as Kraft paper. The rigid evidence enclosure design of the present inventions contemplate the need for adequately retaining heavier evidence items than which can be normally carried and retained within a flexible bag construction, the enclosure further being alterable by material characteristics in order to provide any desired range of breathability or, alternately, waterproof/air tight sealing which can be desirously matched with the properties of the evidence retaining material which is stored therein.

In additional applications, the rigid construction can incorporate semi fluid absorbent materials, these typically being preferred in evidence gathering operations where it is necessary to maintain the integrity of items such as blood or semen covered clothing. In applications such as these, it has been found that a non-breathing, or waterproof/impermeable, material would result in compromising the contained evidence items.

In additional applications, it is desired that the rigid construction of the enclosure exhibit some degree of non-absorbency of fluids, and this may be provided either by substituting the corrugated paperboard material with other materials exhibiting the necessary properties. It is envisioned that this could include a plasticized film or like suitable insert for placement within the interior surfaces of the rigid enclosure in order to establish desired retention properties.

The rigid construction 10 is provided in blank form and, in a semi-assembled state, includes a three dimensional and four-sided construction with interconnected sides 12, 14, 16 and 18, a closed bottom 20. A surface applied indicia patch or appliqué, see at 22, is applied to a selected side of the rigid construction and includes data entry fields for recordation at the time of evidence tagging and storage within the open interior of the enclosure. As will be further described in reference to the succeeding variants, the patch or covering 20 can be redesigned for use with a punch out section defined in the body and in order to both provide for secure re-closure of the opening along with additional recordal or indicia entry of the events associated with the re-access of the evidence contents (e.g. date evidence container was reopened, the circumstances under which such occurred such as including testing and follow up examination, the date the evidence was replaced and the container resealed, etc.).

Also shown at 21 is a window, such as provided by a rigid transparent plastic sheet, and which is mounted such as against an inward supporting frame location surrounding a perimeter defining edge 23 associated with a previously cutaway portion of the rigid construction (see side 14). Tamper evident mounting of the plastic window 21 against the inner facing perimeter of the rigid container surrounding the inner perimeter 23 is typically accomplished with the use of a heavy duty two sided adhesive which affixed against opposing facing perimeters of the plasticized window 21 and the box surrounding the perimeter 23 and which prevents the window from being easily detached (in any non-tamper evident fashion) or re-secured to the box construction.

In this fashion, the window 21 can be mounted against either interior or exterior surfaces of any one or more selected side(s) of the rigid construction 10 in a manner which permits ease of viewing of the previously tagged and stored evidence items and while preventing any form of non-tamper evident removal, the result of any attempt (such as with a sharp edge object or the application of a pushing or prying force to the window) being either or both the destruction of the plastic window and or tearing of the bounding edges of the rigid paperboard construction. It is further envisioned that the rigid transparent window can be manufactured into the original blank design of the container, such as which may include a mechanized punch-out for removing a portion of a selected side of the container blank, to which the rigid transparent window is glued or otherwise chemically or mechanically affixed.

As best shown in FIG. 2, a four sided and top fold over flap configuration is depicted for providing enhanced sealing and structural support to enclosed contents of the rigid container, this including the ability to carry heavier evidence items without fear of tearing or damage and such as which can be associated with weaker Kraft paper supported evidence bags. The flap configuration includes a first pair of opposing and inner supporting flaps including a first smaller flap 24 (shown in FIG. 2) extending along side 14 and which is initially folded inwardly over the open interior of the rigid construction 10.

Following inward folding of the smaller flap 24, an opposite and parallel spaced flap (depicted extending along open top edge of side 18) is folded over the enclosure and includes a main overlaying portion 26 and a succeeding and individually pivotal edge fold over lip portion 28. A peel away strip 30 is applied over a tacky surface distributed along an inner facing surface of the end most and bendable lip portion 28 and, upon being removed, reveals a remaining exposed side of a strong two-sided adhesive and which permits the inner and structurally supporting flap 28 to be adhered along an upper location of the side 14 of the rigid construction (again FIG. 1) while also being shouldered by the upper surface of the inwardly folded and underside supporting smaller flap 24.

A further pair of outer and fold over flaps are provided in spaced apart fashion along interconnecting sides 12 and 16 which alternate with inner fold over sides 14 and 18. The outer flaps are constructed such that first bendable sections overlay an enclosure defining perimeter established with an interior of the enclosure and second bendable sections abutting to establish a carry-able support location.

This is specifically referenced by each of the flaps including first and second interconnecting and inter-pivotal portions, see at 32 and 34 for side 12 and at 36 and 38 for side 16. The outer angled flap sub portions 34 and 38 each include a curved slot shaped cutout, see inner defined perimeter walls at 40 and 42 respectively, and which, upon removing additional peel away appliqués 44 and 46, such as which may cover any portion or all of either or both outer flaps, allow the exposed surface of the previously affixed two-sided adhesive to cause the flaps to be folded together in the fashion depicted in FIG. 1 to define a hand-hold location and thereby provide the dual function of enclosing the box-like construction in a tamper evident fashion, as well as providing durability/carry-ability of the (typically heavier, sharp edged and/or bulky) evidence item(s) carried therein.

Referring now to FIGS. 3-6 in succession, a related variant of rigid evidence carrying enclosure is generally depicted at 48. The enclosure 48 is largely identical to that depicted previously in FIGS. 1-2, such that a repetitive description of identical features will not be undertaken.

Figure 3:
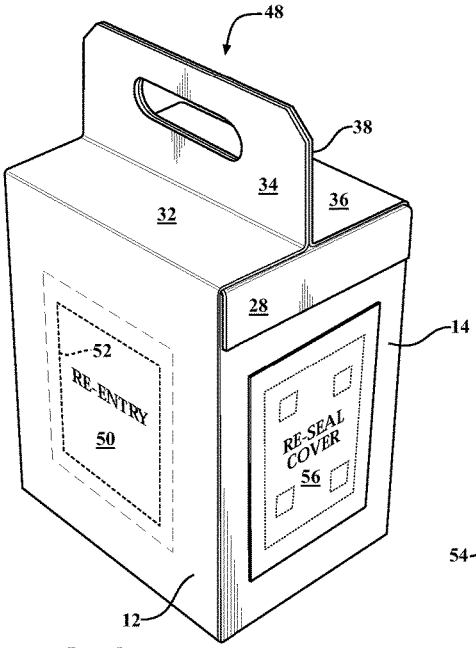
FIG. 3 is a perspective view of a similar rigid evidence retaining structure and further depicting tamper evident resealing features depicted along two selected sides thereof.

As initially depicted in FIG. 3, a perspective view of the rigid evidence retaining structure additionally illustrates a variant of evidence re-accessing and re-securing which permits controlled, verifiable and documentable of the particulars associated with the access and subsequent resealing of the evidence contents, such as for purposes of further examination or testing following initial tagging. In the embodiment shown, the re-access and resealing features are depicted along two selected sides (12 and 14 as correspondingly depicted in the variant of FIG. 1).

A (typically rectangular) removable panel 50 is depicted along an interior location of the selected side 12 and is of sufficient dimensions to facilitate interior access and removal of previously tagged and enclosed evidence items (not shown). The panel 50 is supported in place within the side 12 by an outer framing and perforated or weakened/scored line, further shown at 52, and which extends around the perimeter (four sides) of the panel.

Figure 4:
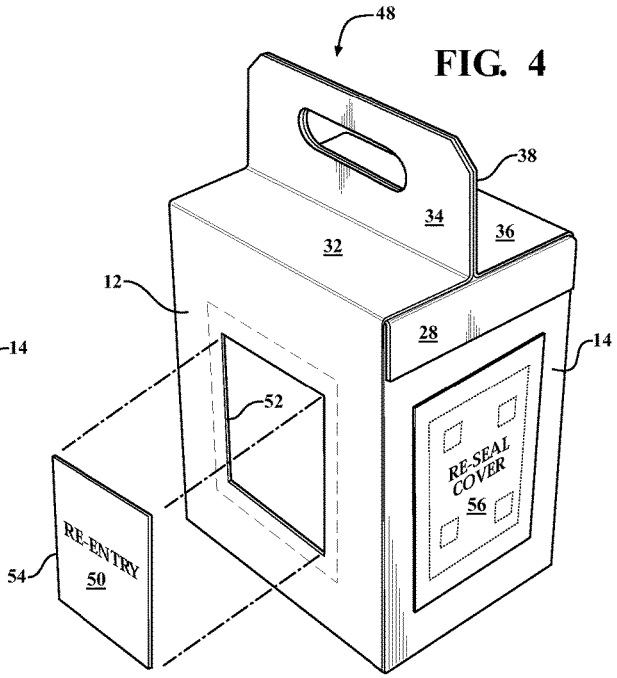
FIG. 4 is a succeeding view to FIG. 3 and further illustrating removal of a corrugated punch out section associated with a first selected side of the structural enclosure.
Figure 5:
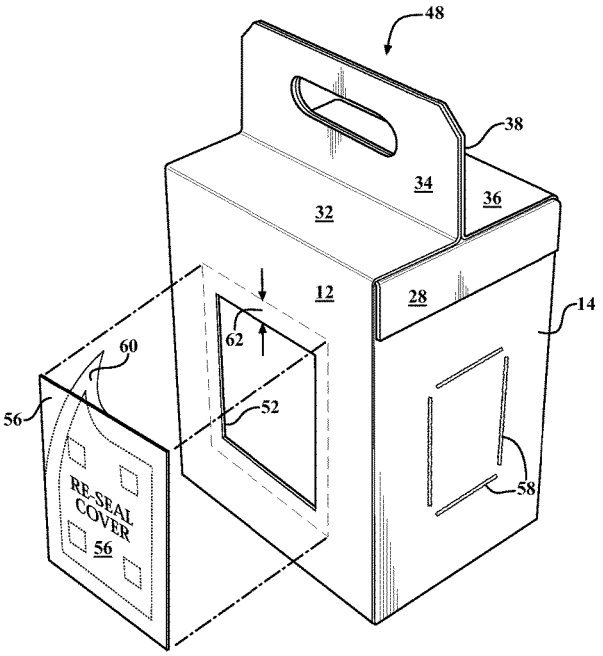
FIGS. 5 and 6 are further succeeding views in which a cover patch is removed from a second side of the structure in FIGS. 3 and 4 and, upon removal of a tacky surface covering, is applied over and around the punch out section in order to effectively reseal the evidence retaining structure.
Figure 6:
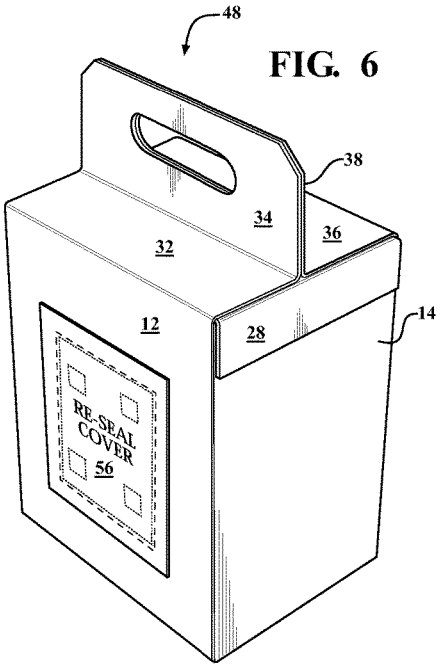

Proceeding to FIG. 4, the panel 50 is removed from the perforation line 52, such as by initially punching inwardly in order to separate the outer edges of the panel 50 (see at 54) from the adjoining perforated line locations 52 or by pre-inserting a flattened/sharpened edge (such as a tip of a flat headed screwdriver) through a selected perorated location and subsequently prying outwardly in order to progressively fracture additional weakened connections established around the outer edge perimeter 54 between the panel 50 and the perforated line 52.

Following removal of the panel 50 to access the previously deposited and tagged contents within the interior of the receptacle, and once it is desired to re-deposit and reclose the evidence container 48 in an evidentiary documentable and tamper proof fashion, a cover patch 56 is detached from any selected side (such as depicted at 14) of the enclosure 48. It is understood that the location of the patch 56, which can be temporarily supported in relatively easily pull-away fashion such as by a surface glue or like minimal tacky adhesive composition (of which a residue is shown at 58 along side 14 in FIG. 5) can also be located on any selected side of the container, such further including being initially supported over and around the perforated line 52 so as to be congregated to a single side 12 of the enclosure.

The cover patch 56 can include either a rigid (likewise corrugated) or flexible material composition, the latter including a polymeric entrained and tear-proof body. Upon removal of a tacky covering appliqué sheet or layer 60 (FIG. 5), an inner facing and more tacky surface is revealed in an outer framed perimeter location (such as corresponding to an outer perimeter margin depicted in FIGS. 5 and 6 and which corresponds to a width 62 established between the scored/perforated edge 52 from which the panel 50 was previously removed and the outer perimeter edge of the overlay patch 56. As further depicted in FIG. 6, the cover patch 56 is shown installed in place (the previously punched out panel 50 having been disposed of) over the perforated line 52 and such that the tacky adhesive resists any pulling or removal of the patch 56 without being readily tamper evident.

As previously shown in FIG. 1, the surface applied appliqué 22 (which is replicated by the cover patch 56) provides any plurality of data entry fields for documenting both the particulars of the initial evidence tagging, as well as any subsequent re-access and re-closure as may be dictated by further needs of law enforcement or applicable court procedures. Without limitation, this may include the provision of an evidence entry form in which a listing of such fields includes (without limitation) each of: Property/Evidence Envelope: Date, From Who Obtained, Where Obtained, Defendant, Alias, D.O.B., Address, Social Security Number, Birthplace, Date of Offense, Sex, Race, Height, Weight, Hair, Eyes, Co-Defendant 1, Co-Defendant 2, Complaint No., District of Arrest, Date/Time, Charge, District of Arrest No., Property Book, description of Evidence, Where Obtained, Seized By, Assigned To, Purchased By, Amount Paid, Collected By, and Assigned by. Additional fields relevant to the person recovering and sealing evidence include those for: Sealed By: Signature, Date, Time, Print Name, Assigned, Picket Up By, Location Picked Up, Date, Time, Witness, Lab No., Received By, Work Unit, Date and Time.

The purpose of the various data entry fields is to provide a written record of all of the particulars relating to the original evidence collection and retention, such as associated with a criminal event. As previously stated, situations often exist where retrieval of the evidence is required, such as during an ongoing criminal legal investigation or court action, and in which the access to evidence during discovery or at trial is needed, such as in order to confirm or refute a suspect's alibi and/or to substantiate an issue of fact supporting a legal position taken by the prosecution in seeking to establish a charge against the suspect being charged.

Additional data fields relevant to the evidence re-entry event can include each of: Evidence Obtained, Person Name, Defendant Number, Defendant Name, Date, Time, Alias Name, Chief of Police Signature, Date, Time, Arrest Date, Property Room Officer Signature, Date, Time and Lab Number. It should be noted that, typically, the above referenced and recordable information fields are in particular for documenting the particulars of the re-entry and subsequent tamper evident-resealing event are separate and in addition to the initial evidence entry fields utilized to document the initial evidence gathering and tagging particulars. It should further be noted that, additional or alternative to imprinting the indicia recordable fields upon the exterior of the surface applied patch or rigid covering, it is envisioned that some or all of the data inscribable fields can be imprinted upon other surface locations along the top, sides or bottom of the container, with the patch or covering in this instance not providing any degree of indicia recordable aspect.

Figure 7:
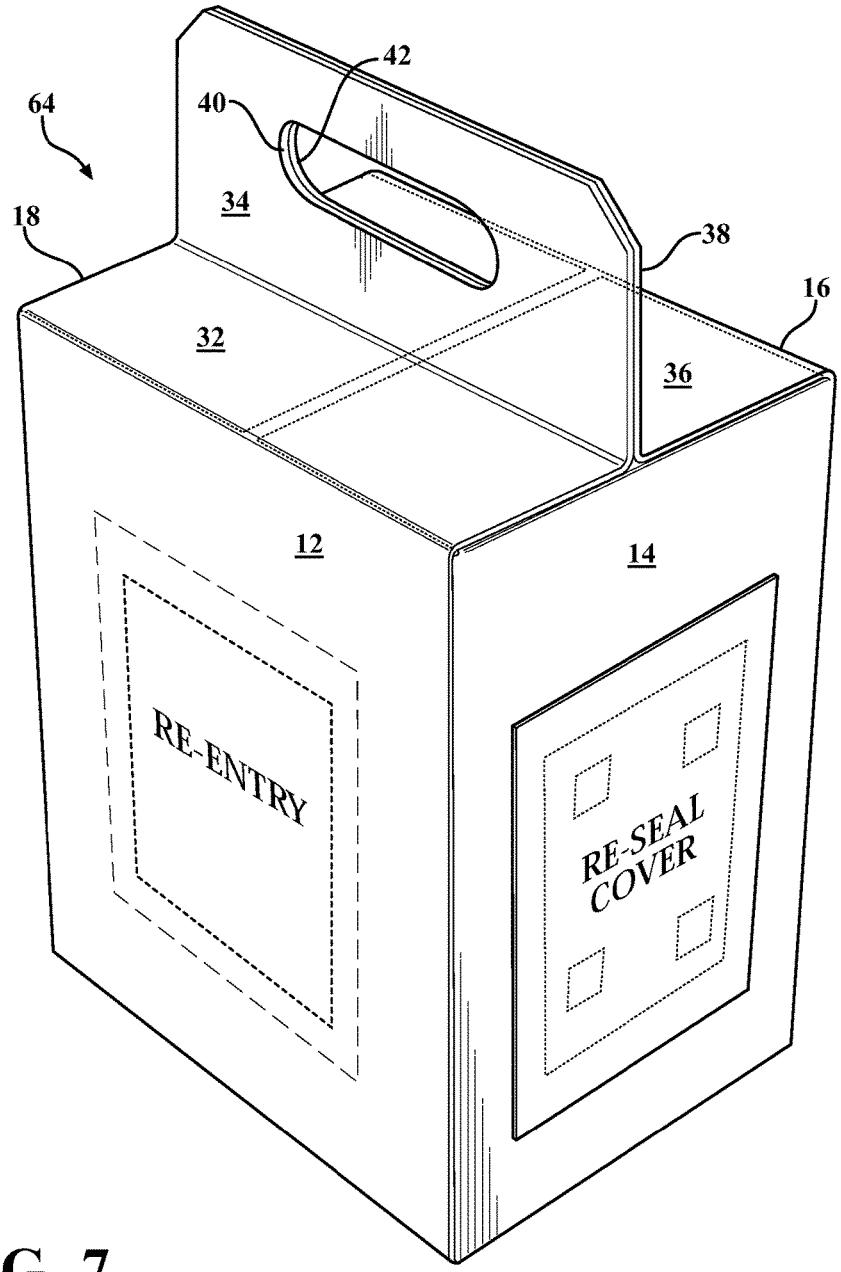
FIG. 7 is a variant of a rigid evidence retaining structure similar to that depicted in FIG. 3.
Figure 8:
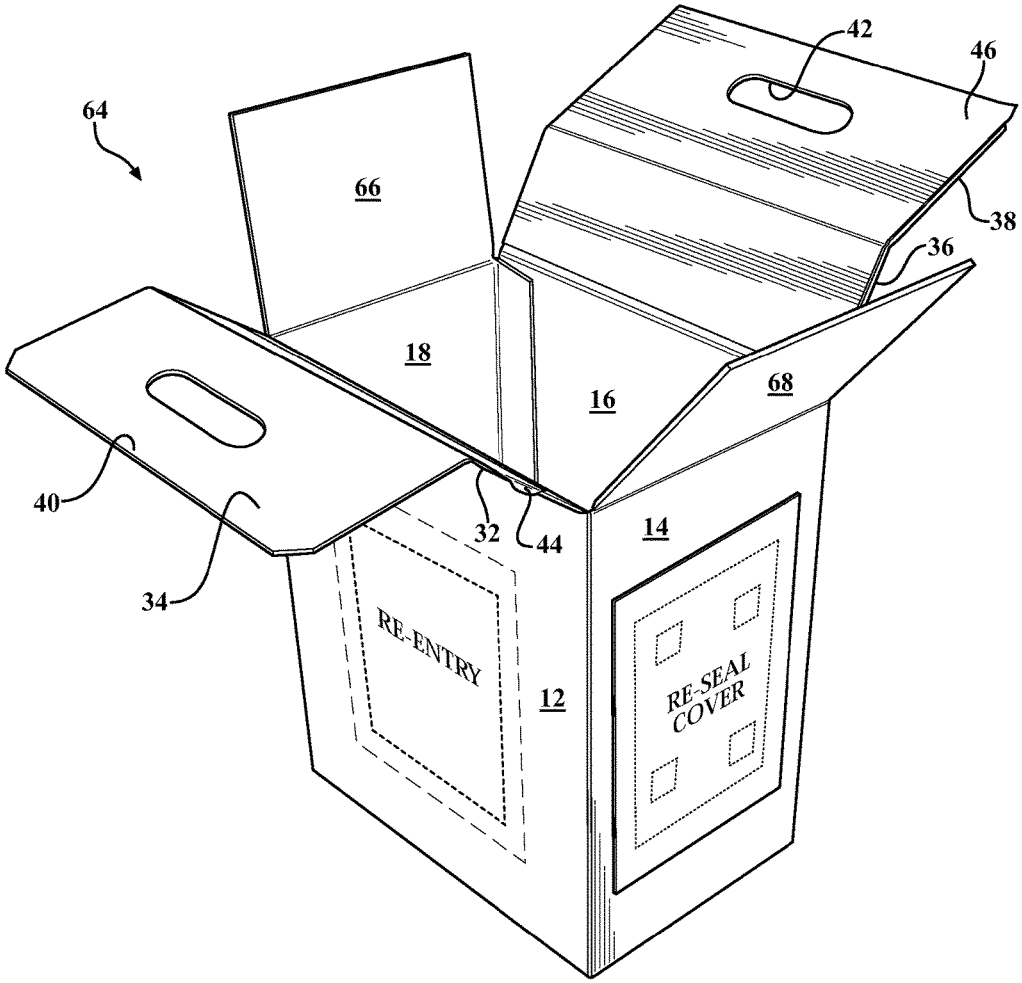
FIG. 8 is an illustration similar to that shown in FIG. 2 and by which the modified top flap arrangement substitutes the inner fold over and structurally supporting flap with a pair of equally dimensioned inner flaps between the spaced and opposing folded and outer sealing flaps.

Referring finally to FIGS. 7 and 8, a variant is shown at 64 of a rigid evidence retaining structure, largely similar to that depicted in FIG. 3 with the exception being a redesigned flap arrangement. Specifically, and comparing FIG. 8 to previously discussed FIG. 2, the outer and inter-foldable flap configuration depicted by bendable flap sections 32/34 and 36/38 is repeated, along with hand-hold slots 40 and 42 and tacky surface covering peel away adhesives 44 and 46. FIG. 8 further illustrates, in place of the inner fold over and structurally supporting flap 26/28 in FIG. 2, a pair of equally dimensioned inner flaps 66 and 68 extending from upper edges of corresponding sides 14 and 18 and between the spaced and opposing folded and outer sealing flaps 32/34 and 36/38.

Having described my invention, other and additional preferred embodiments will become apparent to those skilled in the art to which it pertains, and without deviating from the scope of the appended claims.

I claim:

1. A rigid and tamper evident evidence container, comprising:

a plurality of interconnected sides, a bottom and upwardly extending and inter-foldable flaps extending from said sides for sealing and holding an item of evidence previously deposited within an enclosure defined interior established within the container;

access and tamper-evident resealing structure being located along at least one facing side of said container to allow for re-entry of a pre-sealed container and for re-sealing in thereafter tamper evident fashion;

said structure including an inner panel supported within a side of the container via a plurality of weakened perforated locations, said panel being forcibly dislodged to reveal an opening communicating with the evidence holding interior, a replacement patch removably secured to the container, said patch further exhibiting an outer perimeter greater than a perimeter associated with said perforated locations, said patch exhibiting a tacky inner surface upon a reverse face which is revealed upon removal of a covering layer and such that said tacky surface corresponds at least to an overlapping portion of said container surrounding the opening for securing said patch over the opening in a manner preventing subsequent removal without permanently damaging said structure; and an indicia inscribing location established along an exterior surface of the container and providing recordable information fields for documenting particulars for each of initial evidence entry and subsequent re-entry and resealing events.

2. The invention as described in claim 1, said container further comprising a rigid and corrugated material exhibiting either waterproof/non-fluid absorbent or fluid absorbent properties.

3. The invention as described in claim 1, said replacement patch further comprising at least one of a flexible or rigid construction.

4. The invention as described in claim 1, said flaps further comprising a pair of opposite edge extending flaps exhibiting first inner and second outer bendable sections, said inner bendable sections overlaying an enclosure defining perimeter established with an interior of the enclosure, said outer interconnecting and inter-bendable sections abutting to establish a carry-able support location.

5. The invention as described in claim 4, further comprising a curved slot shaped cutout fainted in aligning locations associated with said outer bendable sections which collectively establish hand-hold locations upon abutting said outer flap portions together.

6. The invention as described in claim 4, further comprising at least one peel away appliqué associated with inner facing locations of said outer bendable sections for allowing said flaps to be folded together in tamper evident and enclosing fashion.

7. The invention as described in claim 4, said flaps further comprising an inner structurally supporting flap extending along a further selected side between said pair of opposite edge extending flaps, said inner flap including a main overlaying portion and a succeeding and individually pivotal edge fold over lip portion, a peel away strip applied over a tacky surface distributed along an inner facing surface of said lip portion and, upon being removed, permitting said inner supporting flap to be adhered along an upper location of a further and opposite extending side of the container.

8. The invention as described in claim 7, further comprising a smaller dimensioned and inwardly foldable flap associated with a side opposite said inner structurally supporting flap and being first folded inwardly to shoulder an overlaying portion of said structurally supporting flap.

9. The invention as described in claim 1, said indicia inscribing location further comprising an evidence entry form located upon an exterior surface of the container.

10. The invention as described in claim 1, said indicia inscribing locations further comprising a plurality of data entry fields incorporated into a surface appliqué applied to the container.

11. The invention as described in claim 1, further comprising a tamper evident window located upon at least one other side, said window including a rigid transparent plastic sheet mounted around a perimeter defined opening.

12. A rigid and tamper evident evidence container, comprising:

a plurality of interconnected sides, a bottom and upwardly extending and inter-foldable flaps extending from said sides for sealing and holding an item of evidence previously deposited within an enclosure defined interior established within the container;

said flaps further comprising a pair of opposite edge extending flaps exhibiting first inner and second outer bendable sections, said inner bendable sections overlaying an enclosure defining perimeter established with an interior of the enclosure, said outer interconnecting and inter-bendable sections abutting in a vertical extending direction originating from a midpoint location over the enclosure to establish a carry-able support location;

access and tamper-evident resealing structure being located along at least one facing side of said container to allow for re-entry of a pre-sealed container and for re-sealing in thereafter tamper evident fashion, said access and resealing structure further comprising an inner panel supported within a side of the container via a plurality of weakened perforated locations, said panel being forcibly dislodged to reveal an opening communicating with the evidence holding interior, a replacement patch removably secured to the container, said patch further exhibiting an outer perimeter greater than a perimeter associated with said perforated locations, said patch exhibiting a tacky inner surface upon a reverse face which is revealed upon removal of a covering layer and such that said tacky surface corresponds at least to an overlapping portion of said container surrounding the opening for securing the patch over the opening in a manner preventing subsequent removal without permanently damaging said structure; and an exterior facing surface of said patch exhibiting a plurality of data entry fields for documenting particulars for each of initial evidence entry and subsequent re-entry and resealing events.

13. The invention as described in claim 12, said replacement patch further comprising at least one of a flexible or rigid construction.

14. The invention as described in claim 12, further comprising a curved slot shaped cutout formed in aligning locations associated with said outer bendable sections which collectively establish hand-hold locations upon abutting said outer flap portions together.

15. The invention as described in claim 12, further comprising at least one peel away appliqué associated with inner facing locations of said outer bendable sections for allowing said flaps to be folded together in tamper evident and enclosing fashion.

16. The invention as described in claim 12, said flaps further comprising an inner structurally supporting flap extending along a further selected side between said pair of opposite edge extending flaps, said inner flap including a main overlaying portion and a succeeding and individually pivotal edge fold over lip portion, a peel away strip applied over a tacky surface distributed along an inner facing surface of said lip portion and, upon being removed, permitting said inner supporting flap to be adhered along an upper location of a further and opposite extending side of the container.

17. The invention as described in claim 16, further comprising a smaller dimensioned and inwardly foldable flap associated with a side opposite said inner structurally supporting flap and being first folded inwardly to shoulder an overlaying portion of said structurally supporting flap.

* * * * *